US007333399B2

(12) United States Patent
Ellner et al.

(10) Patent No.: US 7,333,399 B2
(45) Date of Patent: Feb. 19, 2008

(54) WATCH WITH HIDDEN COMPARTMENT

(75) Inventors: Brenda Ellner, Shaker Heights, OH (US); Paulette Nance, Moreland Hills, OH (US)

(73) Assignee: HourPower Watches, LLC, Shaker Heights, OH (US)

( * ) Notice: Subject to any disclaimer, the term of this patent is extended or adjusted under 35 U.S.C. 154(b) by 638 days.

(21) Appl. No.: 10/448,886

(22) Filed: May 30, 2003

(65) Prior Publication Data

US 2004/0071048 A1 Apr. 15, 2004

Related U.S. Application Data

(63) Continuation-in-part of application No. PCT/US02/17063, filed on May 31, 2002, and a continuation-in-part of application No. 09/630,056, filed on Aug. 1, 2000, now Pat. No. 6,618,328.

(60) Provisional application No. 60/418,694, filed on Oct. 16, 2002, provisional application No. 60/384,243, filed on May 30, 2002, provisional application No. 60/180,543, filed on Feb. 7, 2000.

(51) Int. Cl.
*G04B 37/00* (2006.01)
*G04C 23/02* (2006.01)
*A44C 5/00* (2006.01)

(52) U.S. Cl. ..... 368/88; 368/278; 368/281; 368/309

(58) Field of Classification Search ..... 368/10, 368/88, 276, 278, 281–283, 309
See application file for complete search history.

(56) References Cited

U.S. PATENT DOCUMENTS

| | | | | |
|---|---|---|---|---|
| 1,165,262 | A | | 12/1915 | Jolly |
| 2,219,277 | A | | 10/1940 | Kaufmann |
| 2,235,095 | A | | 3/1941 | Barthman |
| 2,948,106 | A | * | 8/1960 | Blumstein ..... 368/244 |
| 3,722,206 | A | | 3/1973 | Bergey |
| 3,864,905 | A | | 2/1975 | Richardson |
| 4,444,513 | A | | 4/1984 | Proellochs et al. |
| D285,417 | S | | 9/1986 | Nakane |
| D303,503 | S | | 9/1989 | Kai |
| 4,903,250 | A | | 2/1990 | Cho |
| 4,945,523 | A | | 7/1990 | Lam |
| 5,138,590 | A | | 8/1992 | Masuda et al. |
| D339,299 | S | | 9/1993 | Kawashima |
| 5,262,763 | A | * | 11/1993 | Okuyama et al. ..... 345/87 |
| D352,469 | S | | 11/1994 | Schlup |
| D353,778 | S | | 12/1994 | Hanagata |

(Continued)

OTHER PUBLICATIONS ebay advertisement for "Rare 17 Jewel Gold Bulova Flip Up Photo Watch 1940," printed Nov. 8, 2005.

*Primary Examiner*—Vit W. Miska
(74) *Attorney, Agent, or Firm*—D. Peter Hochberg; Sean Mellino; Katherine R. Vieyra

(57) ABSTRACT

A timekeeping apparatus having a hidden compartment. The compartment can contain permanent or removable psychological messages and/or printed messages, pictures or photographs. The apparatus has a timepiece which is pivotable relative to a backing. The backing has a removable door on its underside which is removed for placement of the message into the backing. The user can then lift open the timepiece to reveal the message in the hidden compartment.

7 Claims, 11 Drawing Sheets

U.S. PATENT DOCUMENTS

| | | | | |
|---|---|---|---|---|
| 5,384,756 | A | 1/1995 | Pelosi | |
| D380,393 | S | 7/1997 | Molas | |
| 5,657,298 | A | 8/1997 | Choay | |
| 5,663,932 | A | 9/1997 | Weng | |
| D391,872 | S | 3/1998 | Sugarman et al. | |
| 6,002,651 | A | 12/1999 | Baccaray | |
| 6,079,872 | A | 6/2000 | Beeson | |
| 6,340,242 | B1 * | 1/2002 | Sandidge | 368/278 |
| D454,076 | S | 3/2002 | Baroche | |
| 2003/0081508 | A1 * | 5/2003 | Tardy | 368/283 |
| 2004/0113793 | A1 | 6/2004 | Braxton | |

* cited by examiner

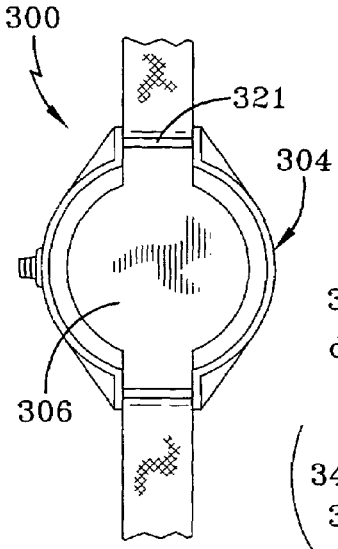
FIG-31
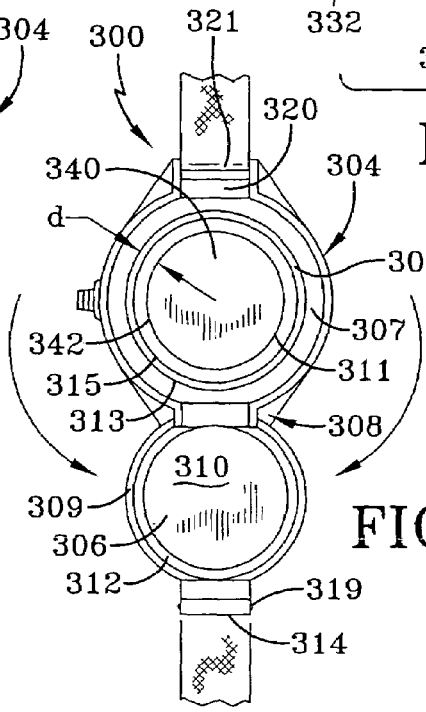
FIG-32
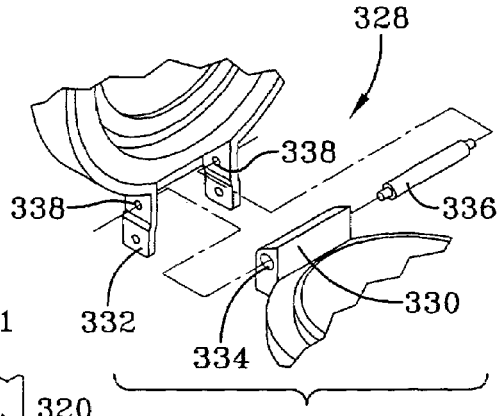
FIG-36
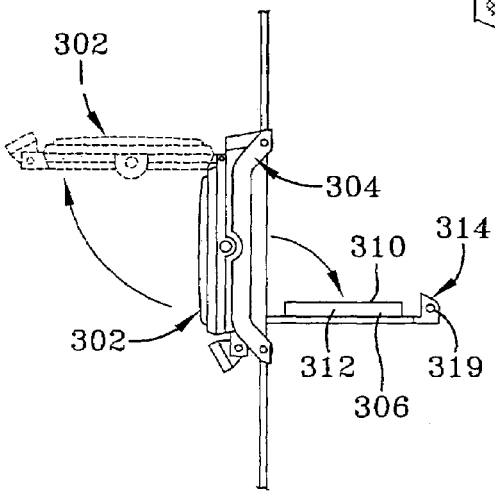
FIG-33
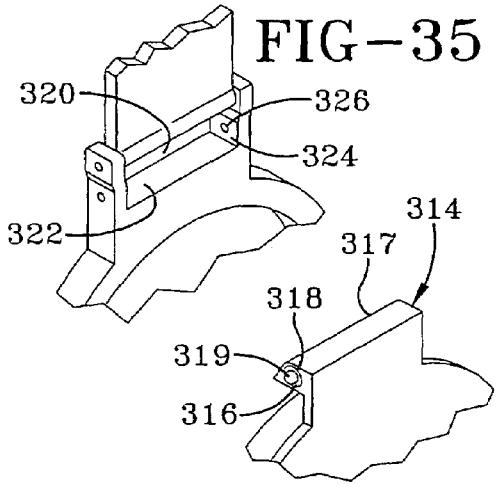
FIG-35
FIG-34

WATCH WITH HIDDEN COMPARTMENT

CROSS REFERENCE TO RELATED APPLICATIONS

This application claims priority of U.S. Provisional Application No. 60/384,243, filed May 30, 2002 and U.S. Provisional Application No. 60/418,694, filed Oct. 16, 2002. This application is also a continuation-in-part application of U.S. application Ser. No. 09/630,056, filed Aug. 1, 2000 now U.S. Pat. No. 6,618,328, which claims the benefit of Provisional Application No. 60/180,543, filed Feb. 7, 2000. This application is a continuation in part of International Application No. PCT/US02/17063, filed May 31, 2002, claims priority to U.S. Provisional Application No. 60/384,243, filed May 30, 2002.

BACKGROUND OF THE INVENTION

1. Field of the Invention

The present invention relates to clocks, timepieces and watches, particularly but not limited to wristwatches having a watch face which is liftable off of or pivotable from a watch back or backing, the watch back having an outwardly facing member for performing a useful function.

2. Description of the Prior Art

There are many different watches which are on the market or otherwise known for displaying information other than the time which is shown on the watch face. Such other information includes the date, time lapsed for a period being measured, telephone numbers, a computer output, etc. These include access to data bases in the circuitry of electronic watches such as an electronic directory for telephone numbers, a computer for performing mathematical computations, and the like.

Watches are also known where the watch face is movable. There are "flip-over" watches in which the watch face is lifted off the watch back, or alternatively pivoted, and flipped over to reveal some artistic message or the like on the back of the watch face. It is well known to place an inscription on the back of a watch backing (the part of the watch that touches the wrist).

There are many watches having moveable accessories for moving the watch face, for covering the watch face, and for revealing another working component associated with a watch. U.S. Pat. No. Des.285,417 (Nakane) shows a wristwatch which can be removed from a backing on the band, and be replaced with a toy aircraft. U.S. Pat. No. Des.303,503 discloses a wristwatch with a calculator, the calculator having a hinged cover. Disclosed in U.S. Pat. No. Des.339,299 is a wrist band holding a wristwatch, a calculator and a telephone index, these being hinged one on top of the other and accessible for their respective use. In another design patent, U.S. Pat. No. Des.380,293, a wristwatch is hinged to provide the cover for a receptacle between the watch backing and the back side of the watch face. A similar device is shown in U.S. Pat. No. Des.391,872.

There are a number of patents showing watches having moveable parts, other than the workings of the watch itself. In U.S. Pat. No. 1,165,262, a watchband has adjustable spring prongs for holding different sizes of watches. A mounting for a watchcase is shown in U.S. Pat. No. 2,219,277, where a watch face can be removably held in a watchband having a backing for the watch. A hinged arrangement is shown in U.S. Pat. No. 4,444,513, where a watch face can be rotated to reveal a different watch. One watch can be analog, and the other digital. U.S. Pat. No. 4,903,250 describes a watch having a memo case disposed adjacent the watch. A display face is fixed, and the memo portion is next to it. The memo portion can be replaced with printed cards. Thus, the watch backing is really a receptacle for the printed cards.

U.S. Pat. No. 5,384,756 discloses a combined identification device and wristwatch. The watch face is hinged over a platform holding a microfilm with the wearer's medical information. If the watch face is lifted up, panels, which are biased upwardly, reveal the microfilm. The microfilm is carried in one of the panels, and another panel has a lens for focusing on the microfilm. The watch backing itself is only, in effect, a receptacle for holding the folded panels.

A modular watch having interchangeable elements is shown in U.S. Pat. No. 5,657,298. A rescue watch is described in U.S. Pat. No. 5,663,932 where the watch assembly has a container chamber holding pressurized liquid or gas to provide air for inflating a device, or for spraying an assaulter when the rescue watch is used for self defense. Some of the watches described above are flip-over watches. Another flip-over watch which is currently on the market is called the Basculante watch. However, neither this watch nor the others described above, carry any member on the backing of the watch, that is the plate upon which the watch normally sits, for performing a useful function.

U.S. Pat. No. 5,384,756 (Pelosi) discloses a timepiece for containing personal identification and/or medical information about the person wearing the device. The device of Pelosi '756 has a housing or case with a timepiece which pivots between an open and a closed position about a hinge. The housing or backing of Pelosi '756 is solid where the timepiece and panels are disposed when the timepiece is closed. In other words, Pelosi '756 has no opening, panel or otherwise removable door on the underside of the timepiece.

SUMMARY OF THE INVENTION

It is an object of the present invention to provide a functional member in connection with a wristwatch, where the device is not readily apparent to others but which can be accessed by the wearer of the watch as desired.

Another object is to provide a wristwatch with a backing holding a function and therapeutic member.

It is another object of the present invention to provide a wristwatch having a message which can be viewed at the discretion of the wearer, but is generally not observable by others.

It is another object of the present invention to provide various types of messages on the backing of a watch. Such messages could be in writing, artistic messages, scents, musical messages, or other visual or auditory messages.

Another object of the present invention is to provide on or associated with the backing of a watch, a removable and/or exchangeable functional and/or therapeutic member.

Another object of the invention is to provide a watch for transmitting a signal to a remote place.

A further object is to provide a watch with a secret or hidden compartment.

Yet another object is to provide a watch with a hidden compartment having messages, such as written messages, artistic messages, scents, musical messages, visual messages, therapeutic messages or auditory messages, or to contain items such as magnets, pictures, natural or synthetic stones or the like.

It is still a further object of the present invention to provide a wristwatch having a backing with a functional member for generating signals to help find the wristwatch itself or the wearer of the wristwatch if they are lost or otherwise cannot be found. This would be useful at night, under avalanches, in the water, etc.

It is yet a further object of the present invention to provide a means for lifting a watch face from a watch backing to render a functional and therapeutic member on the watch backing accessible and useable.

The foregoing and other objects of the invention are achieved by means of a wristwatch having a back or backing upon which the watch face (which includes the watch workings) is entirely or partially removable to render a useful device on the watch backing accessible for use. The useful device can be messages which can be permanent, removable, or exchangeable, and could be placed directly on the watch backing itself or on an appropriate disc for holding the message. The message can be a psychological, therapeutic message as discussed below, olfactory messages generating a particular type of aroma, auditory messages such as those produced by particular electronic chips, certain crystals or stones, a photograph or other pictures, an advertising or organizational message, and the like. A person wearing a wristwatch of the foregoing type can gain access to the functional and/or therapeutic member easily and often without the observation of others, to obtain the desired purpose of the member. The watch can have a hidden or secret compartment for containing a variety of messages or for holding a variety of things. The face of the watch can have many shapes, and could be round, square, oval, rectangular, etc.

The invention further involves a functional member mounted on the backing of a watch which can be relayed to a remote place. This would include means for generating a signal such as a visual, auditory, olfactory or electronic signal. Such signals could be observed or otherwise recognized by the wearer of the watch, or else could be useful to third parties and the remote place.

BRIEF DESCRIPTION OF THE DRAWINGS

FIG. 31 is a pictorial rear view of another embodiment of the invention.

FIG. 32 is a perspective rear view of the embodiment shown in FIG. 31.

FIG. 33 is a side view of the embodiment shown in FIGS. 31–32, with the pivotable back door being opened and the timepiece being in both an open and closed position.

FIG. 34 is an exploded side view of the securing device of the embodiment shown in FIGS. 31–33.

FIG. 35 is an exploded perspective view of a corresponding piece of the securing device shown in FIG. 34.

FIG. 36 is a perspective view of the pivot assembly of the embodiment shown in FIGS. 31–35.

DESCRIPTION OF THE PREFERRED EMBODIMENTS

The invention involves a watch having a hidden compartment located between the backing of the watch and the face of the watch, the hidden compartment having a variety of functions. The hidden compartment can hold a message-generating item. The message can be a printed psychological message. The messages can be beneficial to the wearer of a watch. Psychological studies have shown that when a person continually provides positive and informative statements to themselves throughout the day, those persons actually unleash energy to provide for change. These studies show outcomes as varied as increased concentration, athletic ability, business achievements, and well-being. When these persons spend time in this positive way, it actually reduces the distractions of daily life which interfere with brain activity. At the same time, it raises a person's level of consciousness around a desired goal. This, in turn, provides a real pathway to accomplish what these persons want. It also provides a way to increase one's feelings of power, thereby, working more intensively and efficiently.

The watch according to some embodiments of the present invention helps people realize their own inner resources and command change.

Most people are very concerned about the time of day throughout the day as well as the amount of time it takes to do various things in the course of a day. A watch is therefore a very important part of the items which people use. A watch according to some embodiments of the present invention provides a message area on the watch backing which can be hidden from others in a secret compartment, which holds a message such as a psychological message. Whenever a person wants to check the time, or even without checking the time, the person can effect movement of the watch face from the watch backing to view the message and obtain its psychological benefit. The message can be an inner statement which the person can look at and repeat. This message, when viewed, can constantly reinforce its benefit as the message is viewed and repeated. In another embodiment, a mood sensing stone is provided on the watch for contacting with the user's skin. The stone changes color according to the user's mood which the user then can focus on changing.

The watch according to the invention can be used to hold photographs, other pictures or mementos. It could thus hold a photograph of a family member, friend or acquaintance. It could contain medical or other personal information about the wearer. It could contain information about an organization such as a place of employment, a fraternal, religious or governmental organization, or an advertisement. It could also hold secret information such as combinations, microfilm and electronic chips, and a great many other types of material.

Figure 1:
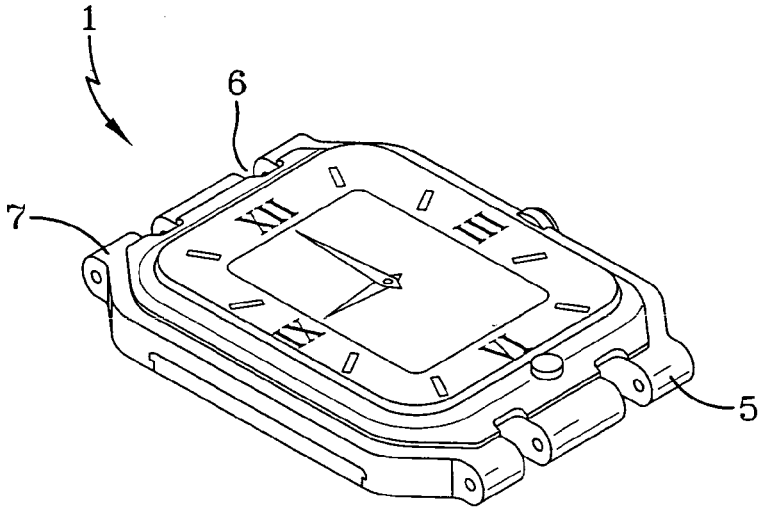
FIGS. 1 and 2 are perspective views of one embodiment of the invention showing a watch face in its closed and open positions, respectively.

Turning first to FIG. 1, which shows an embodiment of the invention in its closed, and ordinary position. FIG. 1 shows a watch assembly 1 having a watch face 3 with a first end 5 and second end 6 configured to receive a watch band. Watch assembly 1 further has a hinge 7 at the second end 6. Watch assembly 1 is shown in the closed position.

Figure 2:
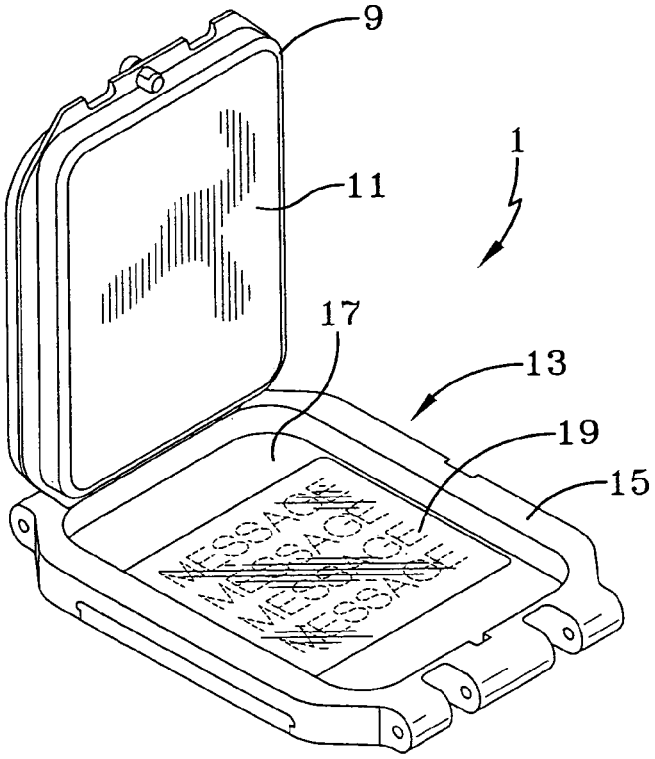

Turning next to FIG. 2, watch assembly 1 is again shown with its timepiece 9 rotated about hinge 7 to its open position. Watch assembly 1 has a rear face 11. Watch assembly 1 has a backing 13 which includes a recess 17. Recess 17 can be a secret compartment, and is bordered by a sidewall 15. A portion of the bottom surface of recess 17 serves as a message bearing area 19. Advantageously, the message can be a psychological message as described above. The message can be in any form, either by means of words, pictures, or, as described later, other means as well. The message can be permanent, or can be removable, or be replaceable with a different message.

Figure 3:
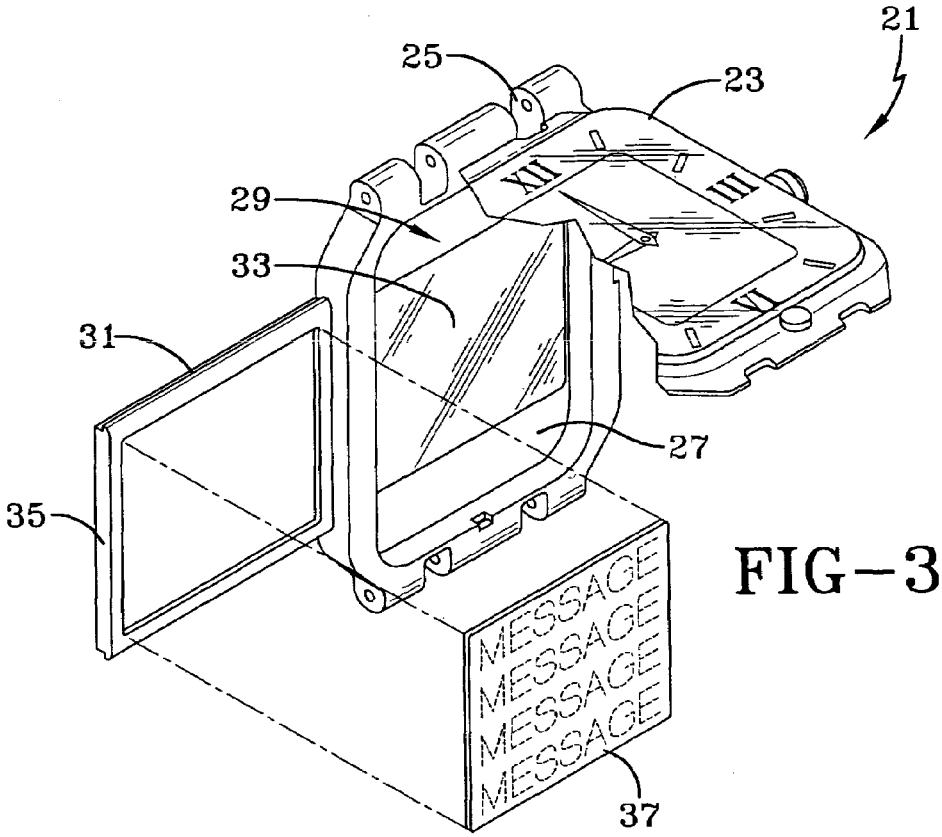
FIGS. 3 and 4 are perspective views of another embodiment of the invention showing the watch face in its raised position in a message bearing frame having a message about to be placed in the frame, and the frame being moveable onto the watch backing, respectively.
Figure 4:
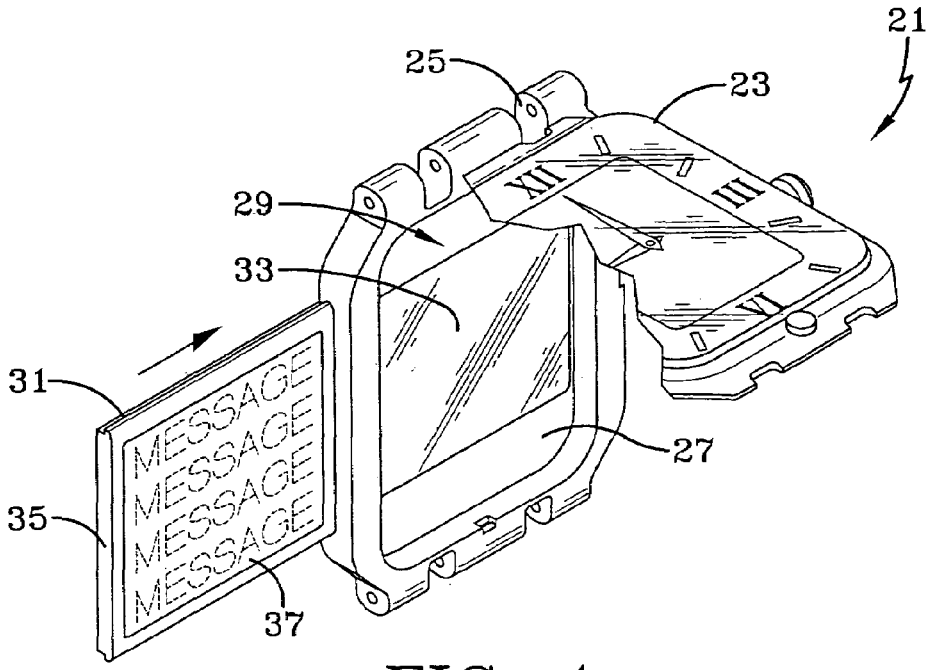
Figure 6:
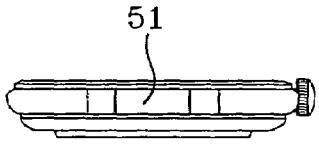
FIGS. 5, 6, 8 and 9 show all four sides of the watch shown in FIG. 7.
Figure 5:
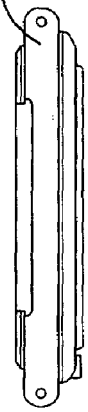
Figure 7:
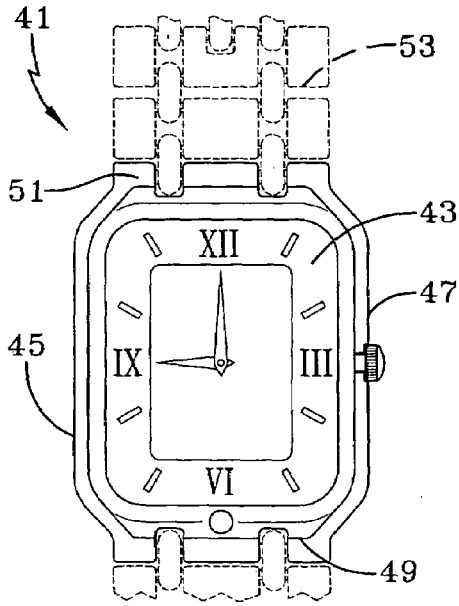
FIG. 7 is a front view of the embodiment shown in FIGS. 3 and 4.
Figure 9:
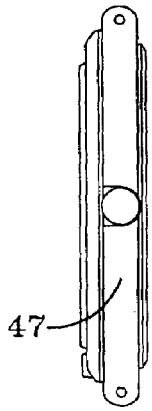
Figure 8:
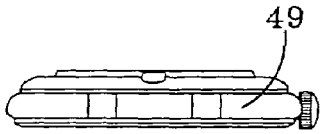

Referring next to FIGS. 3 and 4, another watch assembly 21 is shown. Watch assembly 21 includes a timepiece 23 which is shown pivoted to its open position about a partially shown hinge 25. Watch assembly 21 includes a recess or secret compartment 27 in backing 29. A moveable frame 31, when in its installed position, overlies an area 33 on base 27. Frame 31 includes frame walls 35 in which a sheet, plate or other message bearing object 37 can be inserted. FIG. 3 shows member 37 before it is installed in frame 31, and FIG. 4 shows frame 31 with message-bearing member 37 installed and being moved into backing 29. Frame 31 can be moved so that it overlies backing 29, and is then inserted into recess 27 of backing 29. The dimensions of recess 27 and frame 31 should be such that the frame is held tightly in a semi-interference type fit, but preferably so that it can be released without difficulty in order to change member 37. Alternatively, a slot can be formed in the sidewall of base 29 so that frame 31 can be slid into recess 27 of backing 29.

Timepiece 21 is preferably held in its closed position by a releasable latch, and a button or other release mechanism releases the latch. A spring or other biasing means can bias the timepiece to its open position. FIGS. 5–9 show an embodiment of the invention which can be the same as that shown in FIGS. 3 and 4, or can be a modification thereof. These figures show that a watch assembly according to the invention can look like an ordinary watch, be it round, oval, square, rectangular (as shown), or other symmetrical or irregular shapes, which does not reveal that it has a backing with a secret compartment for holding a message or other functional member. These figures show a timing apparatus 41 having a watch face 43 which is held in a casing having left side wall 45, right side wall 47, first wall 49 and opposite second wall 51. A watch band 53 is connected by an appropriate mechanism at walls 49 and 51. Walls 45, 47, 49 and 51 form on their inside portion, the walls of the backing which holds a functional member.

Figure 10:
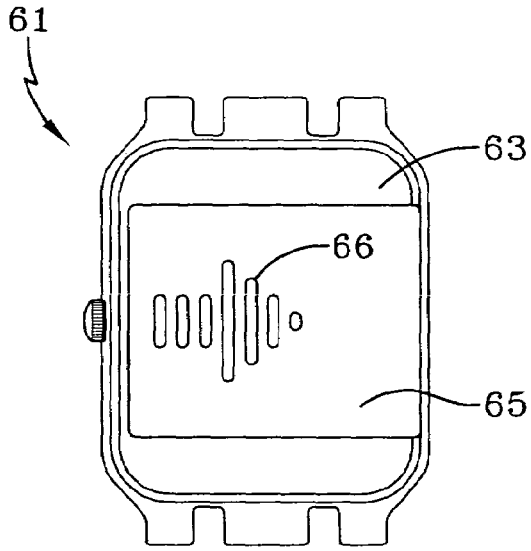
FIG. 10 is a back view of another embodiment of the invention, showing a slidable frame for holding a message.
Figure 11:
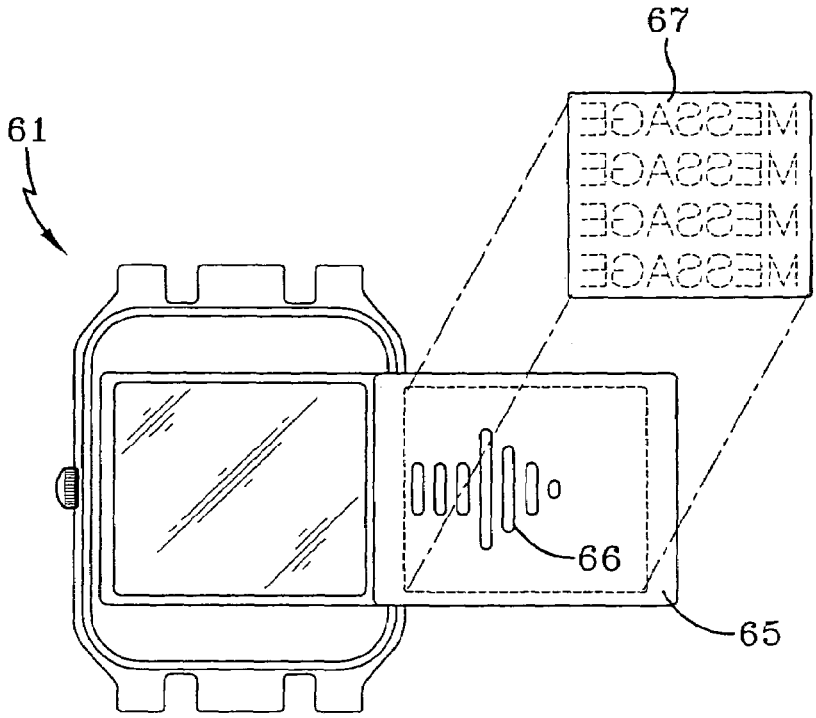
FIG. 11 shows the manner in which the message is inserted into the frame.

Another embodiment of the invention is shown in FIGS. 10 and 11. A watch assembly 61 has a backing 63 on which a timepiece is mounted. Backing 63 can be configured to receive a watch band at both ends. The view shown could also be the front of watch assembly 61. Watch assembly 61 has a removable panel 65 which is slidable from the closed position shown in FIG. 10, to an open position shown in FIG. 11. The direction of movement of panel 65 is indicated by the arrow 66. Panel 65 holds a removable message having a display and can be some sort of plaque, and can be made from plastic or metal. Panel 65 can be moved from the closed position to the open position so that a plaque 67 can be selectively added or removed for viewing, or replaced by a different plaque. The plaques bear the types of messages discussed earlier.

Figure 12:
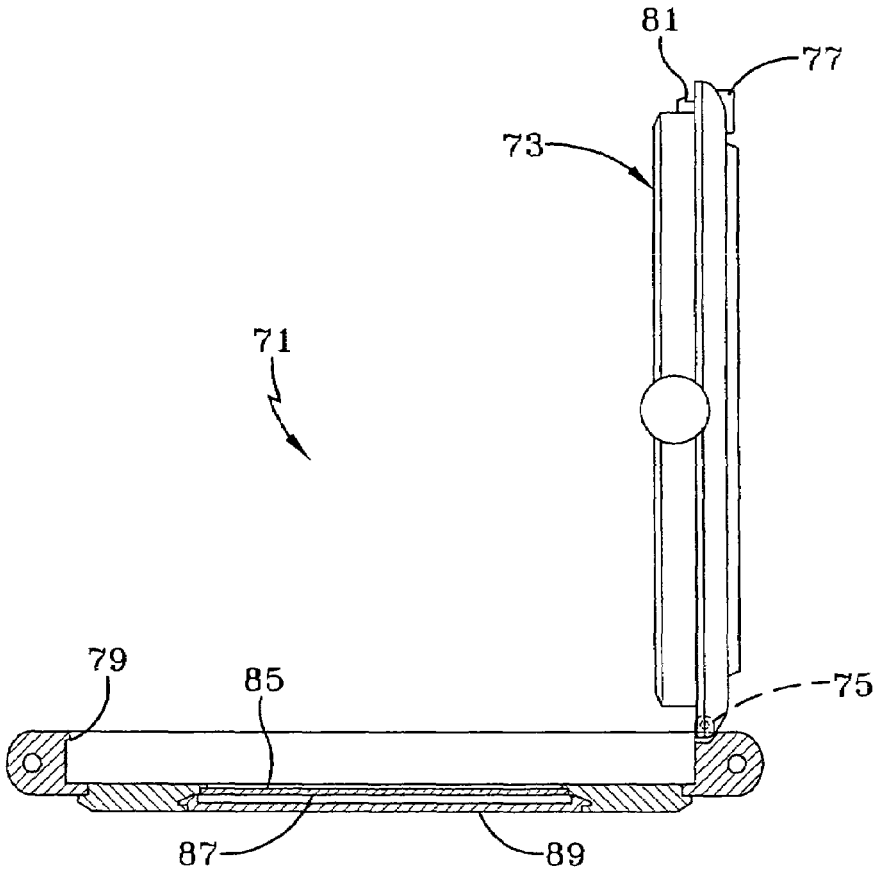
FIGS. 12 and 13 are partially cross-sectional views of an embodiment of the invention showing the watch face in its open and closed positions, respectively.
Figure 13:
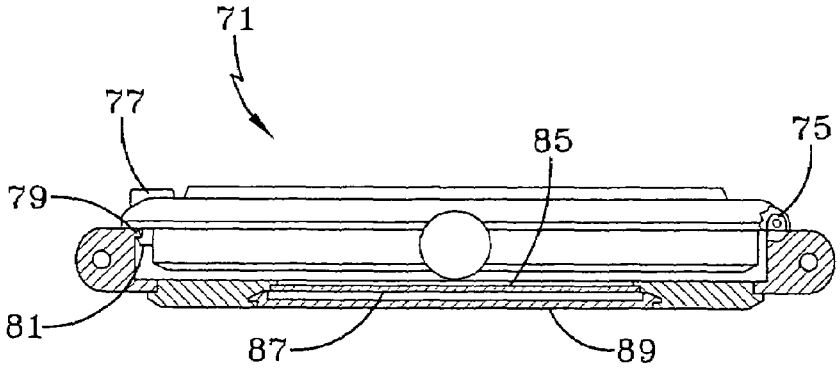

A more detailed view of a hinged watch according to the invention is shown in FIGS. 12 and 13. A watch assembly 71 has a timepiece 73 with which is pivotable about a hinge 75 and held in place in the closed position shown in FIG. 13 by means of a latch assembly composed of a manually operable latch release 77 which cooperates with a locking tooth 79. When timepiece 73 is pivoted about hinge 75 from the open position shown in FIG. 12, to the closed position shown in FIG. 13, a finger 81 connected to latch release 77 engages locking tooth 79 to releasably hold the latch in its locked position. When latch release 77 is depressed, or slid to one side according to the details of the latch assembly, timepiece 73 can be moved to the open position. A spring can be provided to bias time piece 73 to its open position.

Watch assembly 71 has a message assembly 83 which includes a glass panel 85, a message compartment 87 for holding the plaque with the message and a rear push door 89. In order to install a message, rear push door is opened or removed, and a message plaque is inserted against panel 85. The message is placed so that it can be viewed from above, that is from the direction from timepiece 73. Door 89 is then closed or replaced and watch assembly 71 is ready for use. Secret compartments can be located above door 89 or beneath timepiece 73 as shown in the drawings.

Figure 14:
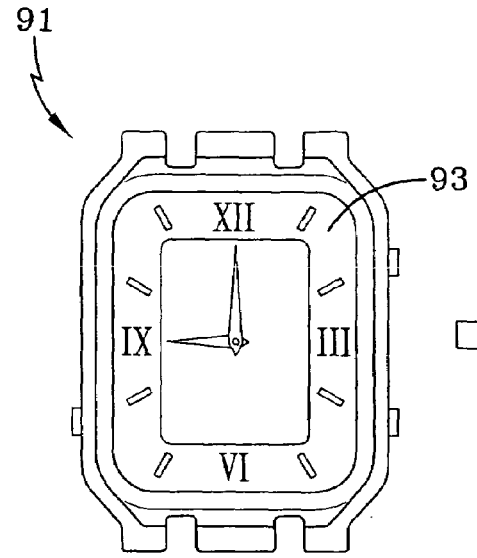
FIGS. 14 and 15 show another embodiment of the invention with a means for revealing a message across the backing of the watch.
Figure 15:
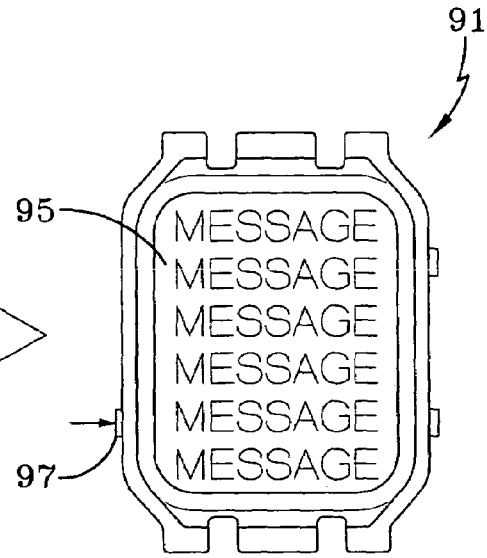

A further embodiment of the invention is shown in FIGS. 14 and 15. A watch assembly 91 is shown. FIG. 14 shows a timepiece 93 installed over and extending into base 95. Timepiece 93 is releasably locked in backing 95. A latch release 97 can be depressed or actuated in some other way, to release timepiece 93 from its locked position. Timepiece 93 is then removed from backing 95 and the message located in backing 95 becomes visible. The compartment between timepiece 93 and backing 95 can be a secret compartment.

Figure 16:
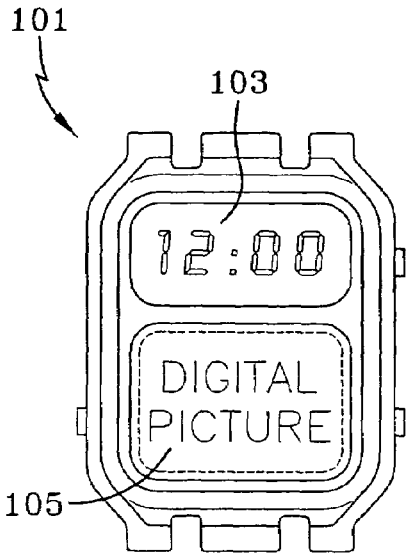
FIGS. 16 and 17 show a variation of the embodiment shown in FIGS. 14 and 15.
Figure 17:
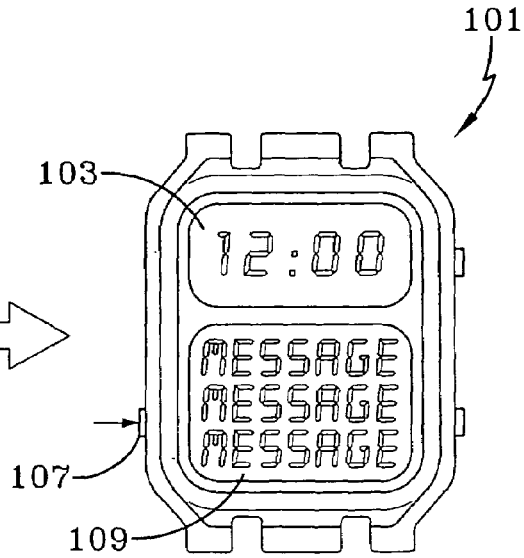

A variation on the foregoing embodiment is shown in FIGS. 16 and 17. In this case, a watch assembly 101 includes a digital display piece 103 and another viewable item located beneath it such as a digital picture 105 shown in FIG. 16. However, upon the depression or other actuation of a release member 107, the digital picture 105 is replaced by a message 109. Digital picture 105 can be an electronic image and by actuating member 107, that image is replaced by the message 109.

Figure 18:
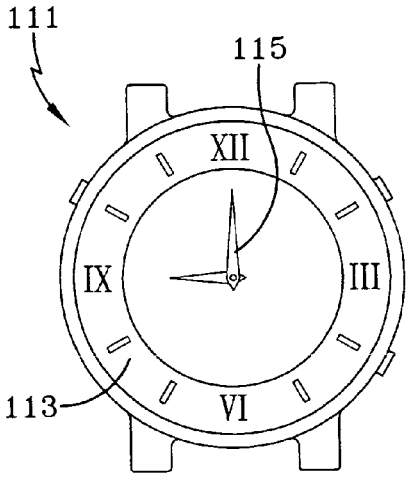
FIGS. 18 and 19 show still another embodiment of the invention with a means for revealing a push-button means for revealing a message on the backing of a watch according to the invention.
Figure 19:
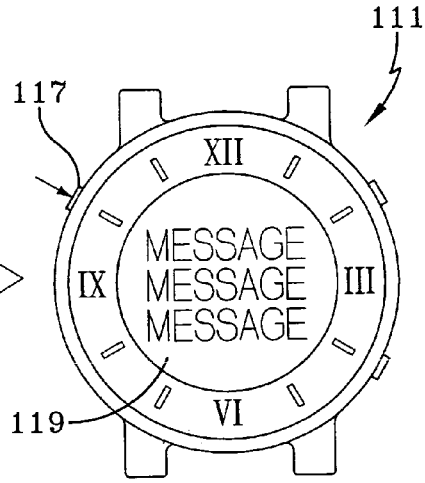

Another embodiment of the invention is shown in FIGS. 18 and 19. FIG. 18 shows a watch assembly 111 with a watch face 113 around the periphery of the front portion of watch assembly, with hands 115 operating in the normal mode. No message is visible. However, upon the depression of an actuating member 117, watch face 113 changes to an auxiliary mode, wherein a message is revealed inside of watch face 113. This message is not observable until member 117 is actuated as shown in FIG. 19. The message is indicated at numeral 119.

Figure 20:
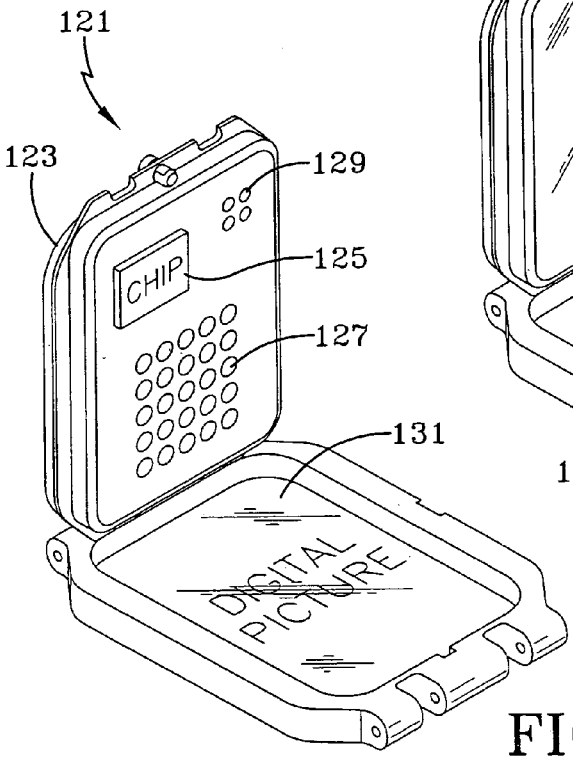
FIG. 20 shows another embodiment of the invention, where a digital picture is held on the backing of the watch.

Yet another embodiment of the invention is shown in FIG. 20. In this case, a watch assembly 121 includes a timepiece 123 which includes on its rear portion and extending into or facing a secret compartment, an electronic voice chip 125 with a speaker 127. Upon the operation of an actuating member, an audible message can be heard through speaker 127. A microphone assembly 129 can be provided in which the user can put his or her own message in the timepiece, and it can be listened to, and changed, as desired. A digital picture or some message can be provided in backing 131 and in the secret compartment. Alternatively, or in addition, other messages besides audio messages can be included in timepiece 123. For example, an aroma generator unit for generating an aroma "message" can be provided for the user.

Alternatively, all of the foregoing items which are included in timepiece 123, can be included in backing 131, as explained earlier. In this case, timepiece 123 would be a cover for the messages and means for emitting the messages, in backing 131.

Figure 21:
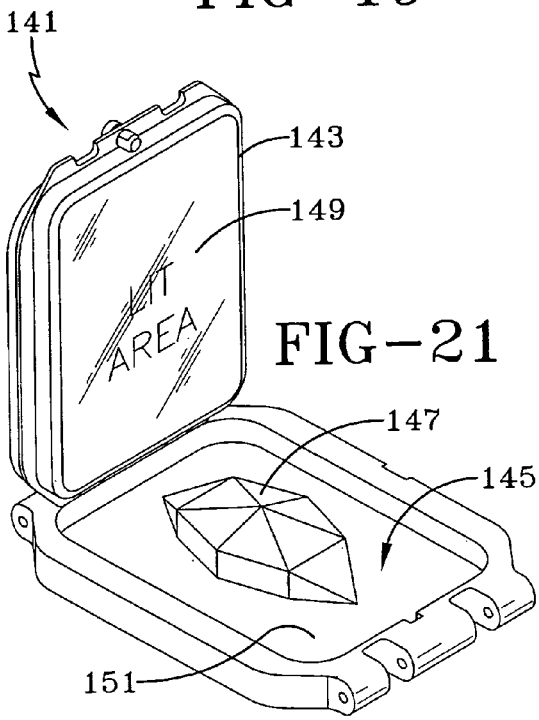
FIG. 21 shows another embodiment of the invention having a watch face which is hinged to be removed from the watch backing, and a functional member is on the back of the watch. The back of the watch or the backing can be illuminated.

FIG. 21 shows another embodiment of the invention. In this embodiment, a watch assembly 141 is shown having a timepiece 143 which is hinged on a wall of backing 145. Backing 145 has a functional member 147 which is shown in schematic form, located in a secret compartment beneath the timepiece when the latter is in a closed condition. Functional member 147 can show a visual message, can emit an audible message, can emit an aroma message, can be an artistic and/or symbolic device which can be viewed for the therapeutic comfort or other beneficial advantage to the user, can emit signals (electronic, audio, visual, etc.) to indicate the whereabouts of the watch assembly or of the wearer of the watch assembly, etc. In some instances, the back of timepiece 143 can be illuminated as indicated by the term "lit area" 149. Another lit area can be provided in base 145 as indicated by the numeral 151.

Figure 22:
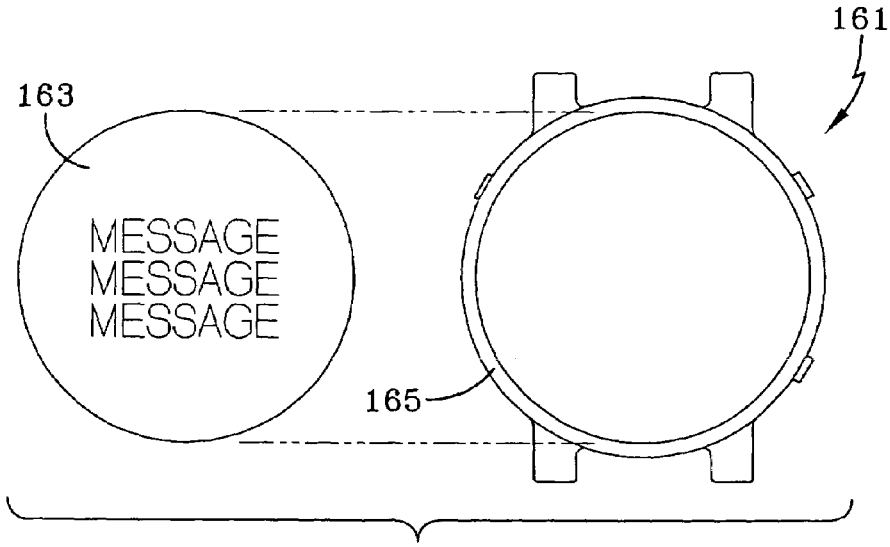
FIG. 22 shows a round watch according to another embodiment of the invention where a message bearing unit is inserted as the watch backing or as part of the watch backing.

FIG. 22 shows a watch assembly 161 viewed from its rear direction. A removable plaque 163 bearing a message is shown removed from the rear of the watch, and can compose the base of the backing of the watch with the message shown on it. It could also be a plaque which is held in place by a removable back wall of the watch. As shown, it can be pushed to place it in its proper position, and can be changed easily. Plaque 163, if forming the base of the watch assembly, is dimensioned so that it is tightly held within the circular walls 165 of watch assembly 161. Other locking means such as a screw type arrangement, or the like can be used as well. A secret compartment can exist between the base and the forward part of the backing.

Figure 23:
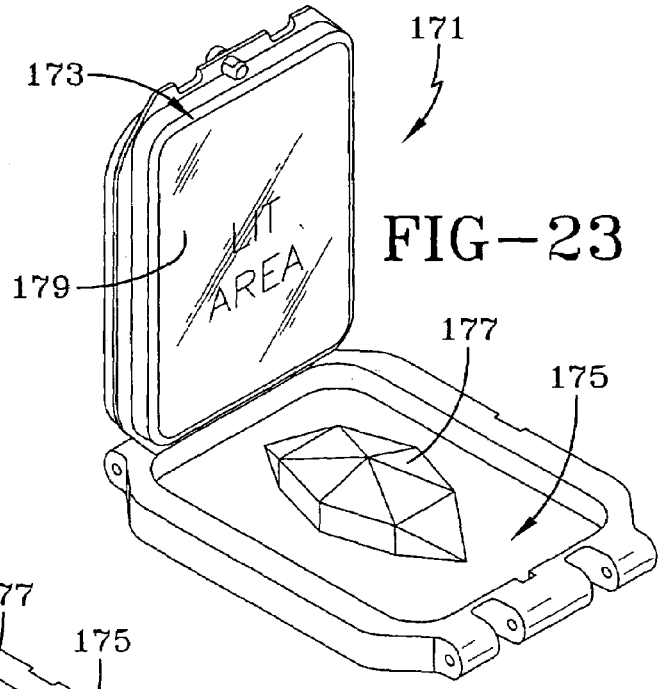
FIG. 23 shows another embodiment of the invention having a stone embedded in the backing of the watch.
Figure 24:
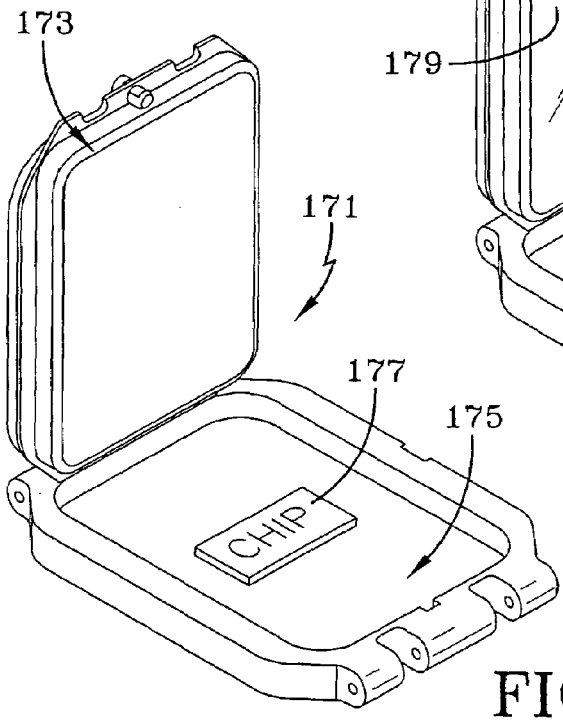
FIG. 24 shows an elevated rear perspective view of the embodiment of the invention shown in FIG. 23 showing the embedded stone protruding through the rear surface of the backing so that when the watch is worn a portion of the stone contacts the wearer's wrist.

Another embodiment is shown in FIGS. 23 and 24. In this embodiment, a watch assembly 171 is shown having a timepiece 173 which is hinged on a wall of backing 175. Backing 175 has a mood sensing stone 177 embedded in the center and located in a secret compartment. The rear of stone 177 protrudes through the bottom of backing 175 such that a portion of stone 177 is pressed against the wearer's skin. Stone 177 will change color according to the emotional state of the user, i.e. calm, angry, sad, irrational, etc. The wearer can check their emotional state by viewing stone 177 by flipping the timepiece 173 upward away from backing 175. The wearer can then alter their behavior if necessary to return to a more normal state of mind. The back of timepiece 173 can be illuminated as indicated by the term "lit area" 179.

Figure 25:
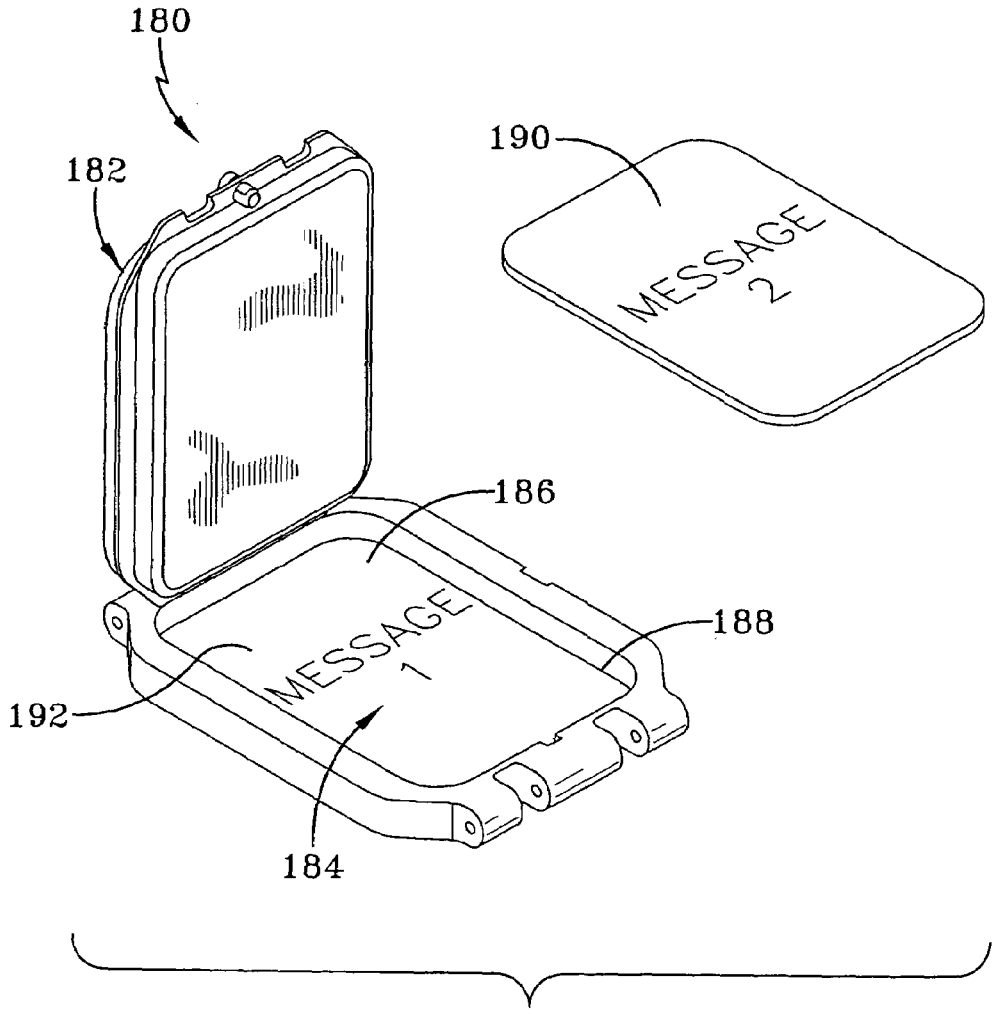
FIG. 25 shows another embodiment of the invention having a removable disc in the backing of the watch.
Figure 26:
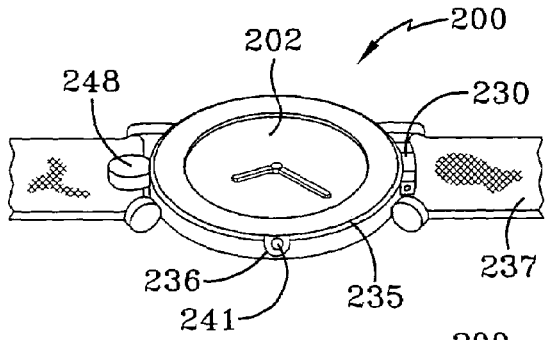
FIG. 26 is a pictorial front view of another embodiment of the invention.

Still yet another embodiment of the present invention is shown in FIG. 25. In this embodiment, a watch assembly 180 is shown having a timepiece 182 which is hinged on a wall of a backing 184. Backing 184 includes a disc 186 containing a message, such as a visual message (i.e. a photograph), an audio message, or an aromatic message and indicated by the term "message." Backing 184 includes an inner compartment 188, which can be also be a cavity, and which provides a housing for disc 186. Disc 186 is preferably of the same shape as inner compartment 188 of backing 184. Moreover, a dial portion 192 is included in watch assembly 180 and can alternatively be provided with the inner compartment for housing disc 186. Of course, either or even both backing 184 and dial portion 192 can provide the housing for disc 186. As depicted in FIG. 25, backing 184, and therefore disc 186, has a substantially square shape. It should be appreciated that backing 184 can have a circular, oval, triangular, octagonal, square, rectangular or other polygonal shape and disc 186 would have substantially the same shape. The wearer can open timepiece 182 to reveal the message therein. Disc 186 is removable and replaceable with an alternative disc 190. If the user so chooses, he or she may remove disc 186 and replace it with disc 190, which is of course just one of any number of alternative discs. It is further appreciated that disc 186 need not necessarily serve as a base for the message as described above, and alternatively the message, such as a photographic message (i.e. a photograph), can be placed directly onto and secured in backing 184.

A particularly preferred embodiment of the invention is shown in FIGS. 26–30. In this embodiment, the backing of the watch assembly can be removed by unscrewing it from the watch body, inserting a disc, a photograph or the like which sits against an inwardly extending ledge, and then screwing the backing of the watch assembly back in the body. An easy tool to use is a coin for being inserted in a slot on the watch assembly backing. The compartment for holding the insert is hidden. The wearer of the watch assembly can pivot the watch front with the dial (i.e. the timepiece) away from the watch assembly body to make the disc, photograph or the like visible.

Figure 27:
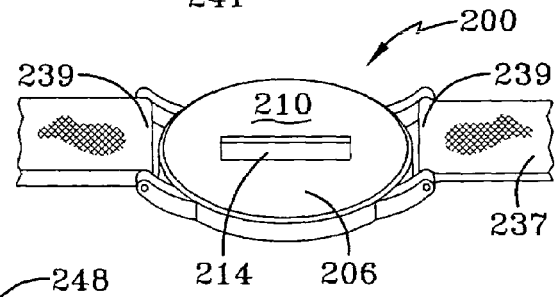
FIG. 27 is a pictorial rear view of the embodiment shown in FIG. 26.
Figure 28:
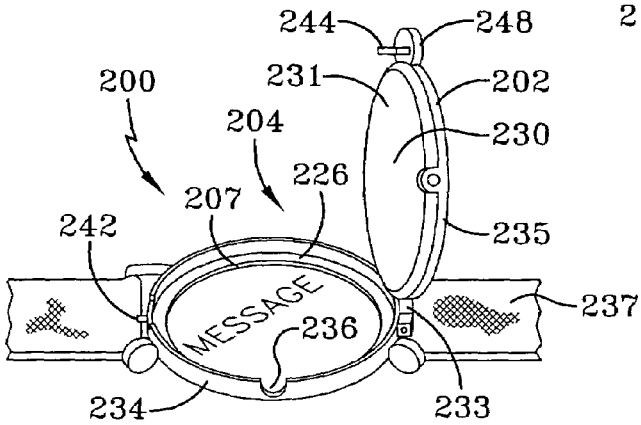
FIG. 28 is a pictorial view of the embodiment of the invention shown in FIGS. 26–27 with the timepiece in a raised position.
Figure 30:
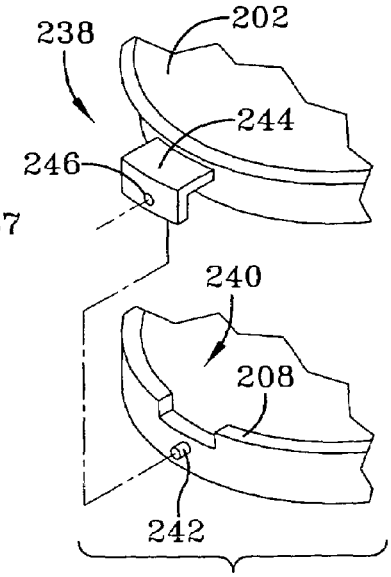
FIG. 30 is a detailed pictorial view of the latching device of the embodiment shown in FIGS. 26–29.
Figure 29:
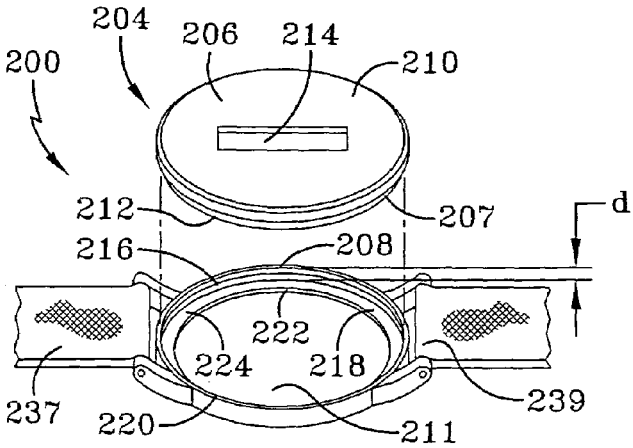
FIG. 29 is a pictorial rear view of the embodiment of the invention shown in FIGS. 26–28 with the backing removed from the watch assembly.

Referring to FIGS. 26–30, a watch assembly 200 is shown having a timepiece 202. Watch assembly 200 has a back assembly 204 comprising a removable backing 206 and a back rim 208. Backing 206 includes a lip 207 for securing the message in place on backing 206, a back plate 210 having external peripheral threads 212 and a slot 214 for receiving a coin or other turning device. Rim 208 has internal threads 216 for receiving threads 212 as backing 206 is screwed into rim 208. Threads 212 and 216 could be bayonet threads to minimize the turns required to remove and install back plate 210. A ledge 218 extends inwardly from rim 208, and is recessed from a back face 220 of rim 208 by a distance d. Distance d enables watch assembly 200 to hold a disc, photograph or other insert after backing 206 is screwed into rim 208 with little or no clearance to prevent wobbling of the insert while enabling backing 206 to be screwed in tightly in rim 208 as shown in FIG. 27. Ledge 218 has a body portion 222 and a seating face 224 against which the insert fits. Ledge 218 also has a forward face 226 to which is preferably attached a clear glass or plastic piece 228 protecting the disc, photograph or the like. Alternatively, glass or plastic piece 228 may be omitted in order to help prevent any undesirable glare against the message therein. Timepiece 202 has a back 230 whose backside 231 can be blank or could have some inscription on it.

Timepiece 202 is connected to the balance of watch assembly 200 by means of a hinge 230 of any appropriate type. Hinge 230 has components on both a forward wall 234 of rim 208 and on a rim 235 of timepiece 202, which are preferably located in line with a band 237 or with the holding members 239 for the band. Rim 208 has at its forward wall 234 an appropriate notch 236 incorporated therein for receiving a manual wind or setting or control button 237 when timepiece 202 is closed in rim 208. Hinge 230 is preferably of the type which enables timepiece 202 to remain at whatever angle it is opened to rather than being biased to an open or closed position, although the latter are within the scope of the invention.

An appropriate device should be incorporated to latch the timepiece in a locked position in order to protect the timepiece and the watch assembly, as well as to maintain the secrecy of the compartment(s): (There is one compartment between the inside surface 211 of back plate 210 and glass or plastic piece 228, and a second compartment between piece 228 and back 230 of timepiece 202. Of course, if piece 228 is omitted as explained above, there is just one compartment.) When timepiece 202 is closed, timepiece rests in the upper compartment of back assembly 204 while the message is secured in the lower compartment of back assembly 204, able to be viewed through glass or plastic piece 228. A locking device 238 that has been found to be particularly beneficial is a retractable pin assembly 240 having a pin 242 biased outwardly from rim 208, and a flange 244 extending from the housing of timepiece 202 having a closed end bore 246 for receiving pin 242 to keep timepiece 202 in a locked position. Flange 244 has a manual handle or knob 248 which a wearer of watch assembly 200 could grasp with his or her fingers to rotate timepiece 202 about a hinge 230, and in so doing having the edge around bore 246 retract pin 242. In order to close timepiece 202, the reverse action is taken. Knob 248 can carry a logo of a school, organization or the like, an advertising message, the name of an organization the name, abbreviation or initials of the wearer and the like.

Watch assembly 200 is a very effective unit. It looks and operates as a conventional watch. Photographs, discs or the like can easily be inserted or removed from the secret compartment. One can easily view the photograph, disc or the like by simply rotating the timepiece from its closed to an open position. Timepiece 202 is shown openable in the direction of the user's wrist band 240, or pivotable away from the user, shown at directional arrow A. It should be appreciated that timepiece 202 can alternatively be opened towards the user (in the opposite direction of arrow A) or in either sideways directions wherein hinge 230 is moved to either side of watch assembly 200.

An additional preferred embodiment of the invention is depicted in FIGS. 31–36. In this embodiment, the backing of the watch assembly can be pivoted from the watch body, a disc, photograph or the like can be inserted into the back assembly and sits against a inwardly extending ledge, and then the backing is pivoted back against the back assembly and locked or snapped into place. An easy tool to use for being inserted in a slot between the pivotable backing and the back assembly will facilitate the pivoting of the backing. The compartment for holding the insert is hidden. The wearer of the watch assembly can still pivot the watch front with the dial (i.e. the timepiece) away from the watch assembly body to make the disc, photograph or the like visible.

Referring to FIGS. 31–36, a watch assembly 300 is shown having a timepiece 302. Watch assembly 300 also has a back assembly 304 comprising a pivotable backing 306 and a back rim 308. Pivotable backing 306 is depicted as pivotable downwardly relative to back assembly 304 when watch assembly 300 is held in an upright fashion so that the time on timepiece 302 can be read. It should be appreciated that pivotable backing 306 can also be pivotable in an upwardly direction, either sideways direction or any other direction relative to back assembly 304. A ledge 311 extends inwardly from rim 308, and is recessed from a back face 307 of rim 308 by a distance d. Distance d enables watch assembly 300 to hold a disc, photograph or other insert after backing 306 is pivoted into place in rim 308. Pivotable backing 306 includes a base 309, a flat annular raised surface 310 and an annular sidewall 312, annular sidewall 312 extending from base 309 to raised surface 310. Raised surface 310 is flat so as to be able to support the insert or message in back assembly 304 when pivotable backing 306 is closed relative to back assembly 304. Raised surface 310, when pivotable backing 306 is closed, corresponds to rim 308 and fits snugly within its parameters, thereby securing the message or insert in place to prevent wobbling of the insert while enabling backing 306 to be secured into place and flat against the user's wrist so as not to be uncomfortable to the user. Ledge 311 has a raised body portion 313 and a seating face 315 against which the insert fits. Ledge 311 also has a forward face 342 to which is preferably attached a clear glass or plastic piece 340 protecting the disc, photograph or the like. Alternatively, glass or plastic piece 340 may be omitted in order to prevent any undesirable glare against the message therein.

Pivotable backing 306 also includes a pushpin housing 314 at one end of pivotable backing 306. In this instance, because pivotable backing 306 pivots downwardly relative to back assembly 304, housing 314 is located at the top of backing 306. It should be appreciated that the exact location of housing 314 on backing 306 will depend on the direction pivotable backing 306 opens. Housing 314 includes an annular bore 316 therethrough, an annular upper surface 317 and a pin 318 which extends through bore 316. Each end of pin 318 holds a retractable ball bearing 319.

Back assembly 304 also comprises a pushpin housing compartment 320 comprising a compartment ledge 322, a back wall 323 and opposing sidewalls 324. A mating hole 326 is located on each of opposing sidewalls 324. When pivotable backing 306 is closed, pushpin housing 314 rests inside pushpin housing compartment 320. Retractable ball bearings 319 retract in order to allow housing 314 to be placed between sidewalls 324, and then ball bearings 319 return to normal position within corresponding mating holes 326. The securing of retractable ball bearings 319 with corresponding mating holes 326 locks or snaps pivotable backing 306 in a closed position relative to back assembly 304, thereby securing the message or insert within. When pivotable backing 304 is closed, housing 314 is secured within compartment 320. A space 321 remains above compartment 320, space 320 able to receive a tool for dislodging housing from 314 from compartment 320, thereby allowing backing 304 to be opened. In other words, when the watch wearer desires to gain access into back assembly 304, he or she inserts a tool, such as a coin, into space 321 to dislodge housing 314 from compartment 320.

Pivotable backing 306 further includes a pivot assembly 328 pivotably securing pivotable backing 306 at its end opposite that from pushpin housing 314 with back assembly 304. Referring specifically to FIG. 36, pivot assembly 328 comprises a pin housing 330 having a hollow bore 334 therethrough for accommodating a pin 336. Pin 336 can be retractable, like pushpin 318 described above, or can be non-retractable. Two additional oppositely placed holes 338 are provided on an inner portion of back face 307 which correspond to bore 334. Pin 336 extends through bore 334 and is secured into each of holes 338 on face 307. A second pin housing compartment 332, which is preferably similar in design as compartment 320 above, is provided on back assembly 304 within which pin housing 330 and pin assembly 328 may pivot. It should of course be appreciated that pivot assembly 328 described herein is but just one example of how backing 306 may be pivoted or rotated relative to back assembly 304 and any other comparable method may be used as well, such as a hinge assembly and the like.

Timepiece 302 is connected to the balance of watch assembly 300 in the same manner as that described in the previous embodiment. All features of the connection between timepiece 302 and watch assembly 300 are included in this reference, along with all the aforementioned features regarding the opening and closing of timepiece 302 relative to watch assembly 300. A detailed description thereof is omitted for the sake of brevity.

The foregoing embodiments could also be used for clocks. For example, a free standing clock having a hinged or otherwise moveable clock section can be opened from a closed position to yield a clock back having the message bearing plaques or other functional member. The concept could also be employed in other such horological instruments such as lockets, pendants, rings, etc.

The invention has been described in detail, with particular emphasis being placed on the preferred embodiments thereof, but variations and modifications may occur to those skilled in the art to which the invention pertains.

What is claimed is:

1. A watch assembly comprising:

a timepiece having a watch dial and an underside;

a back assembly for supporting said timepiece, said back assembly including a housing and having a rim;

a pivotable door on the outside of said back assembly, said door having a first housing with a bore therethrough for receiving a first pin, a second housing with a bore therethrough for receiving a second pin, and an elevated surface defined by an annular wall extending upwardly from said pivotable door;

a mounting member for mounting said timepiece on said back assembly; and a hidden compartment formed between said back assembly and said timepiece for receiving said elevated surface of said pivotable door, said hidden compartment being hidden when said timepiece is closed relative to said back assembly.

2. A watch assembly according to claim 1 and further comprising a transparent panel inside said housing, said clear panel being placed between said elevated surface of said pivotable door and the underside of said timepiece.

3. A watch assembly according to claim 1 wherein said back assembly further comprises a first compartment and a second compartment, said compartments being oppositely disposed on said back assembly and able to receive and secure each of said housings therein, said first compartment and said second compartment further comprising a back wall, a pair of oppositely disposed sidewalls and a bottom wall.

4. A watch assembly according to claim 3 wherein said sidewalls of said first compartment define a bore therethrough and said sidewalls of said second compartment define a mating hole.

5. A watch assembly according to claim 3 wherein said first housing is pivotable inside said first compartment for pivoting said back door relative to said back assembly.

6. A watch assembly according to claim 3 wherein said second housing is removable from said second compartment.

7. A watch assembly according to claim 3 wherein both of said first and second pins have a first and a second end, and at least one of said pins further comprises a pair of retractable ball bearings, one being on said first end and the other being on said second end, whereby said mating holes of said second compartment are able to receive said retractable ball bearings for securing said pivotable door in place.

* * * * *